US005221216A

United States Patent [19]

Gabany et al.

[11] Patent Number: 5,221,216

[45] Date of Patent: Jun. 22, 1993

[54] VERTICAL MOUNT CONNECTOR

[75] Inventors: Andrew J. Gabany, Mechanicsburg; James G. Dunbar, Lancaster, both of Pa.

[73] Assignee: AMP Incorporated, Harrisburg, Pa.

[21] Appl. No.: 885,100

[22] Filed: May 18, 1992

[51] Int. Cl.[5] ..... H01R 13/66

[52] U.S. Cl. ..... 439/620; 333/185

[58] Field of Search ..... 439/620; 333/181-185

[56] References Cited

U.S. PATENT DOCUMENTS

| | | | |
|---|---|---|---|
| 4,684,200 | 8/1987 | Capp | 439/387 |
| 4,772,221 | 9/1988 | Kozlof | 439/620 |
| 4,884,982 | 12/1989 | Fleming et al. | 439/620 |
| 4,934,960 | 6/1990 | Capp et al. | 439/620 |
| 5,062,811 | 11/1991 | Hackman | 439/620 |
| 5,094,629 | 3/1992 | Black et al. | 333/185 |

OTHER PUBLICATIONS

*LAN Coaxial Braid Filter Connectors,* National Tel--tronics, Meadville, Pa. 16335.

*Primary Examiner*—Gary F. Paumen

[57] ABSTRACT

An electrical connector 1 comprising: a conductive contact 6 connected to a circuit board mounting terminal 17, an insulative body 3 surrounding the contact 6, a conductive shell 2 surrounding the insulative body 3, a base 11 surrounding the shell 2, conductive circuit board mounting posts 13 on the base 11, the shell 2 being insulated from the base 11, electrical capacitor elements 26 between the base 11 and a conductive platform 31, and circuit board engaging terminals 34 extending from the platform 31.

12 Claims, 4 Drawing Sheets

VERTICAL MOUNT CONNECTOR

FIELD OF THE INVENTION

The invention relates to a connector that is vertically mounted to a circuit board and incorporates electrical capacitor elements.

BACKGROUND OF THE INVENTION

A known connector described in U.S. Pat. No. 4,684,200, comprises, a conductive shell surrounding an insulative body, a conductive contact surrounded by the insulative body, a mounting terminal on the contact, a base surrounding the shell, and conductive mounting posts projecting from the base. A mating portion of the shell projects from the base. The mating portion is for mated coupling with an electrical connector that is terminated to an electrical cable. The terminal and the mounting posts connect to a circuit board. The mounting posts connect the base of the connector to a conductive ground path of the circuit board. One of the drawbacks of the known connector is that radio frequency interference, RFI, can induce an undesired voltage in a signal contact of the connector.

A connector described in U.S. Pat. No. 5,062,811, comprises, a conductive shell, capacitor elements against the shell, and a conductive clip engaging the capacitor elements and extending to mounting posts projecting from a housing surrounding the shell. Voltages induced by RFI are transmitted through the capacitor elements to a ground path of a circuit board to which the mounting posts are connected. It is desirable to shorten the conductive path between the capacitor elements and the ground path of the circuit board, thereby to reduce the electrical resistance in the circuit path, and to reduce the transmission time of the induced voltages to the circuit board.

SUMMARY OF THE INVENTION

The invention is directed to an electrical connector constructed with a conductive shell and capacitor elements to transmit voltages induced by RFI to a ground path of a circuit board. The capacitor elements are mounted on a top surface of a conductive mounting platform having the top surface facing the shell, and an opposite, second surface facing a circuit board and having circuit board mounting terminals on the second surface. Thereby the conductive path between the capacitor elements and the terminals extends from one surface to the second surface through a thickness of the platform. Voltages induced in the shell by RFI are transmitted through the capacitor elements and their mounting platform to the terminals of the mounting platform adapted for engaging a ground path of a circuit board.

According to the invention, an electrical connector comprises, a conductive contact connected to a mounting terminal, an insulative body surrounding the contact, a conductive shell surrounding the insulative body, electrical capacitor elements in contact with the shell mounted on one surface of a conductive mounting platform, the one surface facing the shell, and an opposite second surface of the platform facing a circuit board and having projecting circuit board mounting terminals, and a conductive path from the capacitor elements extending from the one surface to the opposite surface through a thickness of the platform to the terminals.

The invention will now be described by way of example with reference to the drawings, according to which:

DETAILED DESCRIPTION

Figure 1:
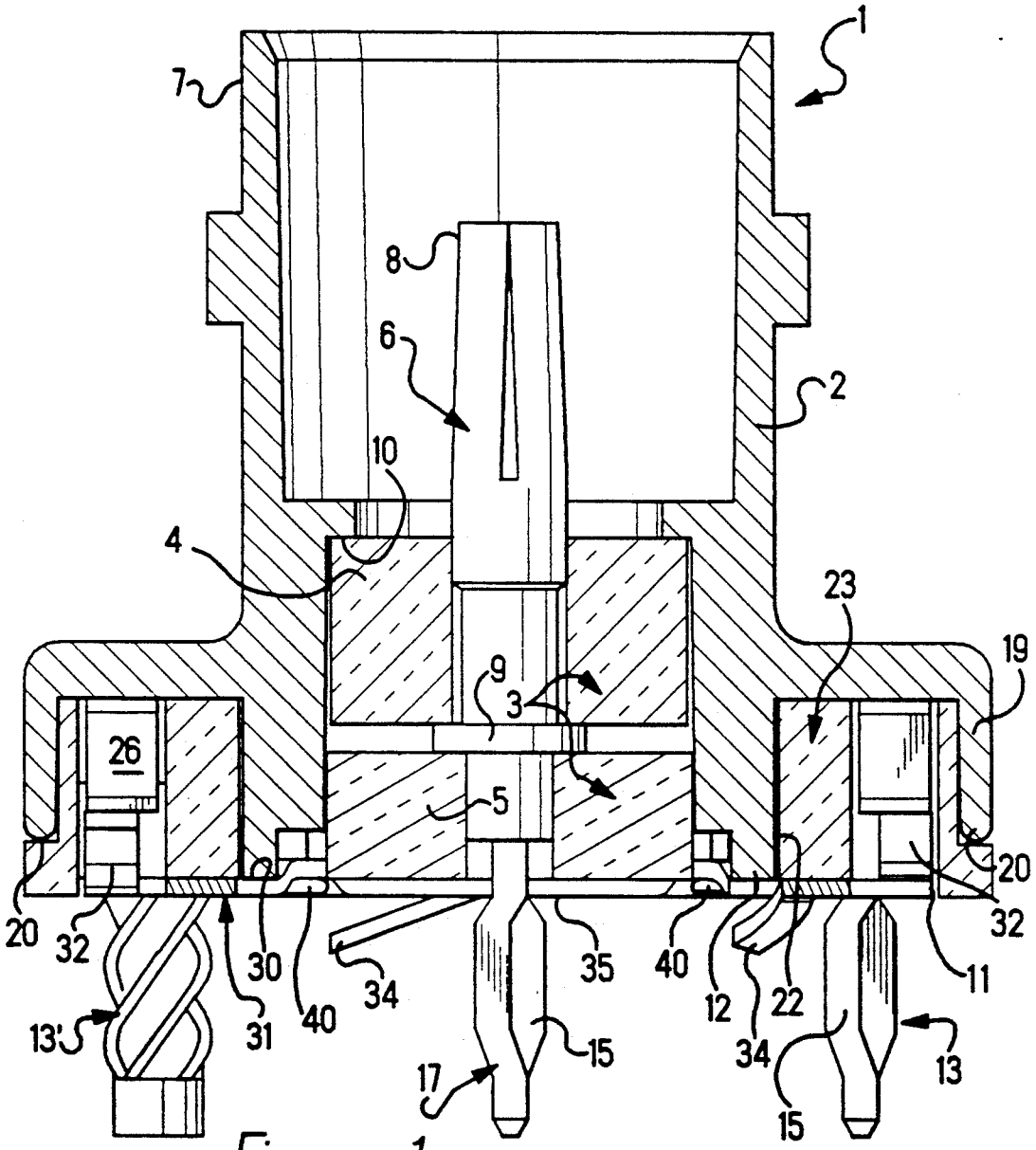
FIG. 1 is an elevation view in section of a connector.

With reference to FIG. 1, a coaxial electrical connector 1 includes a hollow conductive shell 2 surrounding an insulative body 3, comprised of a first cylindrical portion 4 and a second cylindrical portion 5 surrounding a conductive electrical contact 6 concentric within the shell 2. The axis of the connector 1 is the concentric axis of the shell 2 and the contact 6. A top mating end 7 of the shell 2 provides a coupling for mated connection with another, complementary connector, not shown. An electrical receptacle portion 8 of the contact 6 is for mated connection with the complementary connector, not shown. The contact 6 has a radial flange 9 against which the portions 4, 5 of the insulative body 3 are seated. The shell 2 has an internal lip 10 against which the portion 4 seats to prevent movement of the insulative body 3 relative to the shell 2. A corner edge of the shell 2 is indented inwardly radially at various points to provide protrusions 10*a* overlapping the portion 5 to prevent movement of the insulative body 3.

Figure 5:
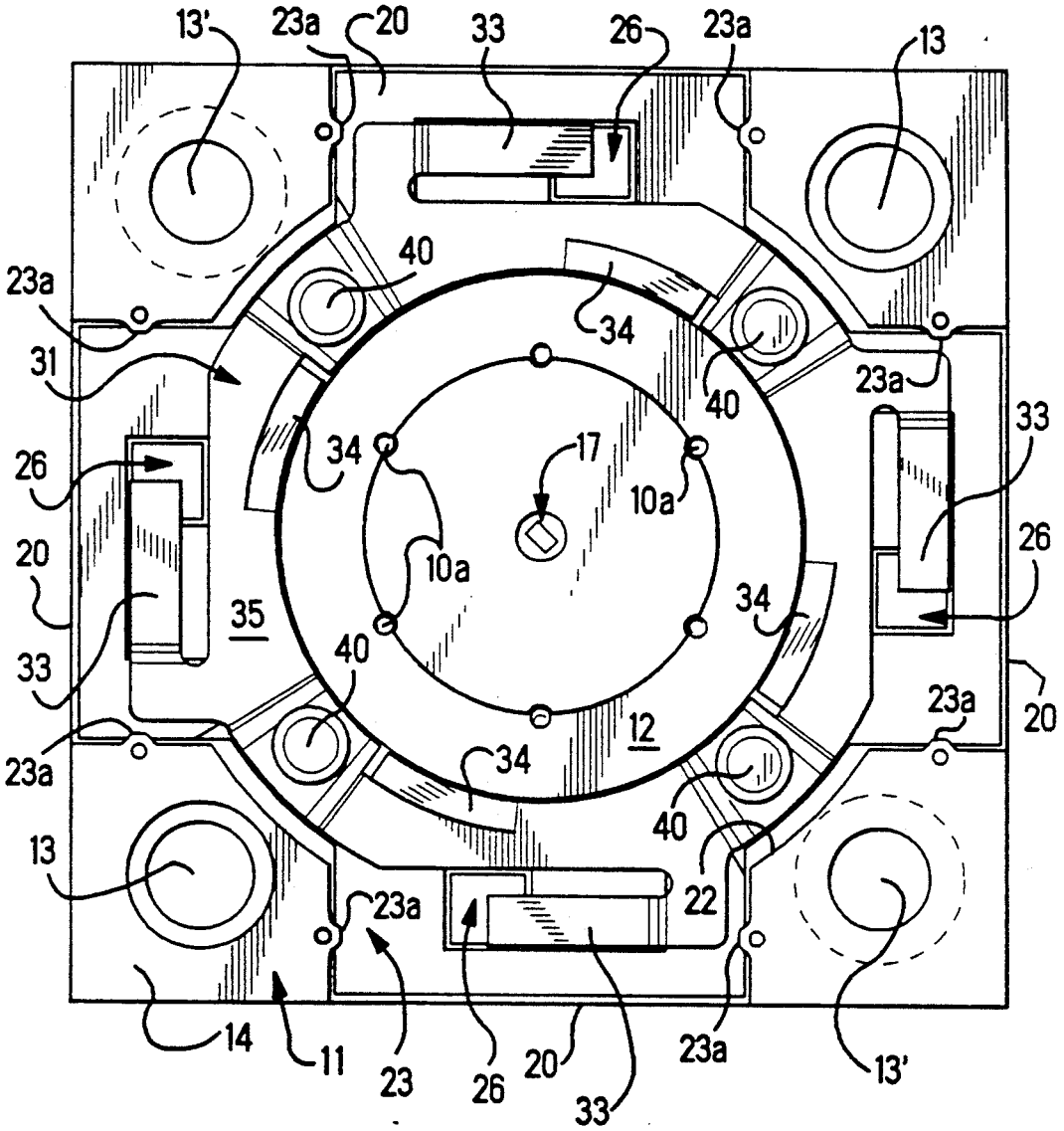
FIG. 5 is a bottom plan view of the structure shown in FIG. 4 mounted in the connector shown in FIG. 1.

A broad base 11, FIGS. 1 and 5, surrounds a bottom 12 of the shell 2. The base 11 is conductive and is a unitary part of the shell 2. Conductive, circuit board mounting fasteners or posts 13 extend beyond a mounting surface 14 in FIG. 5 of the base 11 and are adapted with compliant portions 15 to be connected to a circuit board, not shown. The posts 13 are connected to the base 11. Other fasteners 13' mechanically mount the base 11 to the circuit board, not shown. A conductive, circuit board mounting, electrical terminal 17 of the contact 6 has a compliant portion 15 and extends beyond the mounting surface 14 to be connected to a circuit board, not shown. Further details of the connector 1 are described in U.S. Pat. No. 4,684,200.

Figure 4:
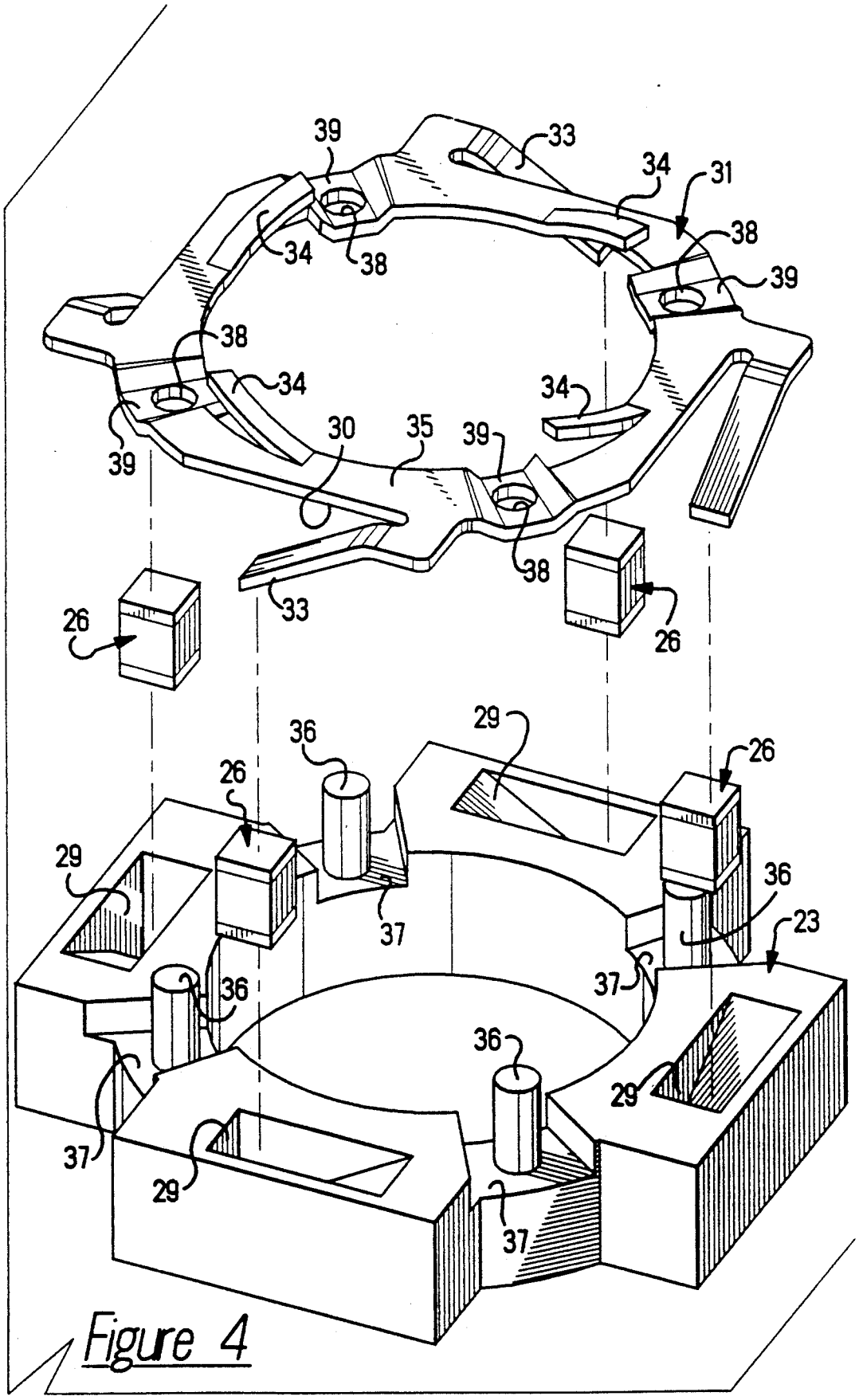
FIG. 4 is a perspective view of the platform shown in FIG. 2 with an insulator.

With reference to FIGS. 1 and 5, the base 11 has a stepped interior passage 22 surrounding the exterior of the shell 2 at the bottom 12. A second insulative body 23 in the form of a ring 25, FIG. 4, is passed over the bottom 12 of the shell 2 and is retained in the passageway 22 of the base 11. Corner edges of the base 11 are indented inwardly radially at various points to provide protrusions 23*a* overlapping the insulative body 23 to prevent movement of the insulative body 23.

Electrical circuit elements such as capacitor elements 26 are placed in passages 29 through the ring 25. The capacitor elements 26 are surrounded by the ring 25, and are supported, FIG. 1, on a conductive platform 31.

Figure 2:
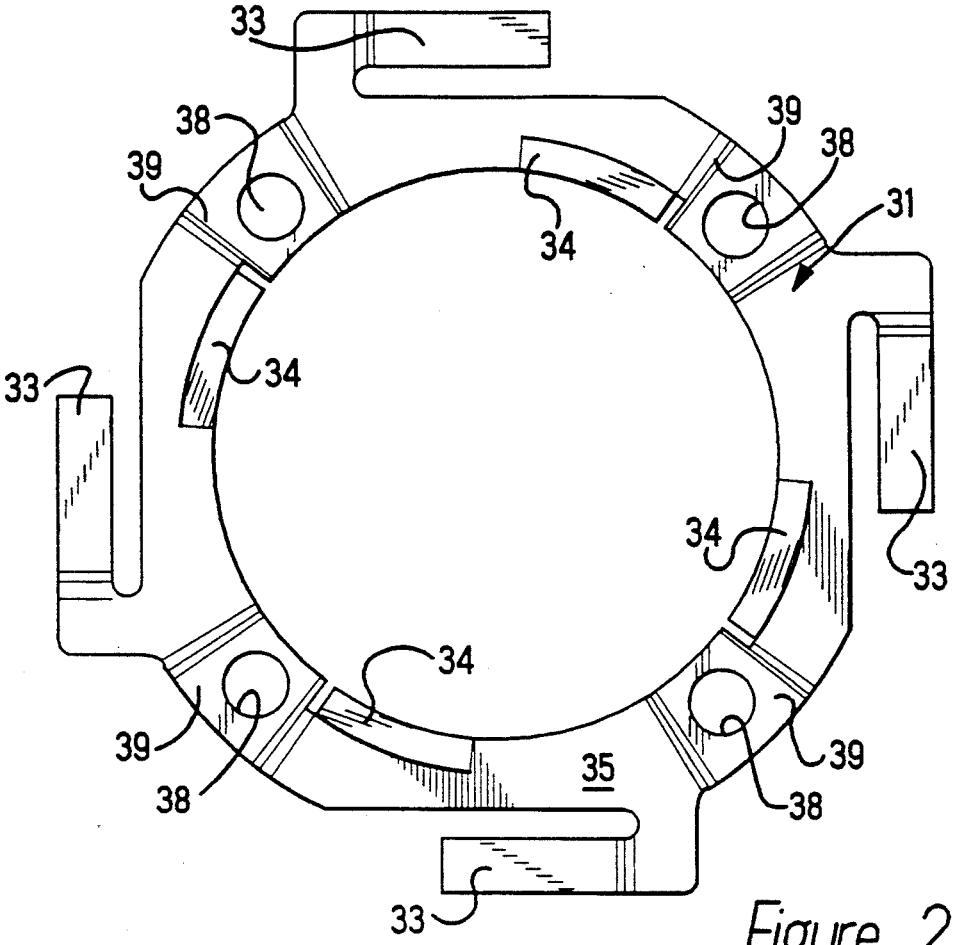
FIG. 2 is a bottom plan view of a conductive platform of the connector shown in FIG. 1.
Figure 3:
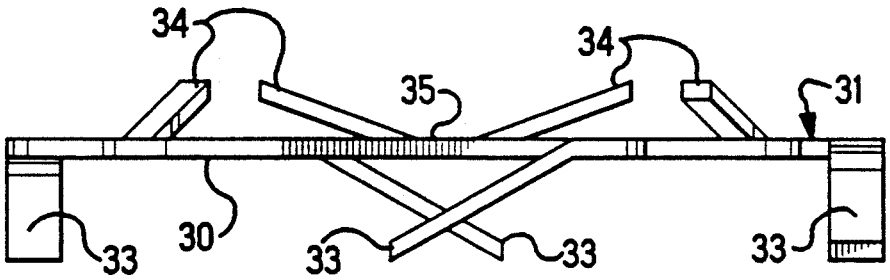
FIG. 3 is an elevation view of the platform shown in FIG. 2.

As shown in FIGS. 2, 3 and 5, the platform 31 comprises stamped and formed metal having an inner opening 32 through its thickness. A set of first conductive resilient spring fingers 33 comprise cantilever beams formed in the thickness of the platform 31 and bent to project into the passages 29 to engage and urge the capacitor elements 26 axially of the connector 1, FIG. 1, and into engagement with the base 11 of the shell 11. Circuit board engaging electrical terminals 34 comprise a second set of conductive spring fingers as cantilever beams formed in the thickness of the platform 31 and bent to project outwardly. The terminals 34 have a circuit board facing surface 35 of the platform 31, and project in the same direction from the base 11 as the fasteners 13 and 13'. The fasteners 13 and 13' project for connection to a circuit board, not shown. Each of the terminals 34 project for resilient engaged connection to a conductive path, not shown, comprising a ground plane of the circuit board.

If a voltage across the shell 2 is induced by RFI, the voltage will be transmitted through the capacitor elements 26, through the thickness of the platform 31 that is defined between the surfaces 30 and 35, and to a ground plane of a circuit board, not shown, to which the terminals 34 are connected.

The platform 31 is attached to the insulative body 23. The insulative body 23 includes unitary posts 36 projecting from recesses 37, and extending through openings 38 through the thickness of the platform 31. The openings 38 are surrounded by recesses 39 stamped as offset areas of the platform 31. Ends of the posts 34 that extend through the openings 36 are enlarged by the application of heat and pressure to form enlarged heads 40, FIGS. 1 and 5, that overlap the openings 38 and retain the platform 31 on the insulative body 23. The heads 40 are recessed from the bottom surface of the platform 31. The insulative body 23 insulates the platform 31 from contact with the base 11.

We claim:

1. An electrical connector comprising: a conductive contact connected to a circuit board mounting terminal, an insulative body surrounding the contact, a conductive shell surrounding the insulative body, the shell having a base, a mating portion of the shell projecting from the base, conductive circuit board mounting posts on the base, electrical capacitor elements in contact with the shell mounted on one mounting surface of a conductive mounting platform, the one mounting surface facing the shell, a second, circuit board facing surface on the platform having projecting circuit board engaging terminals, the one mounting surface and the second surface facing in opposite directions, and a conductive path from each of the capacitor elements extending from the one surface to the second surface through a thickness of the platform to the board engaging terminals.

2. An electrical connector as recited in claim 1, wherein, the base and the shell are of unitary construction.

3. An electrical connector as recited in claim 1, wherein, the one surface and the second surface are on opposite sides of the thickness of the platform.

4. An electrical connector as recited in claim 1, wherein, the platform is secured to insulative material, and each of the capacitor elements is surrounded by the insulative material.

5. An electrical connector as recited in claim 1, wherein, each of the capacitor elements is surrounded by insulative material between the platform and the base.

6. An electrical connector as recited in claim 5, wherein, the insulative material insulates the platform from contact with the base.

7. An electrical connector as recited in claim 5, wherein, the insulative material is a second insulative body received in a cavity of the base.

8. An electrical connector as recited in claim 7, wherein, the platform is secured to the second insulative body, and the second insulative body insulates the platform from contact with the base.

9. An electrical connector comprising: a conductive contact connected to a circuit board mounting terminal, an insulative body surrounding the contact, a conductive shell surrounding the insulative body, a conductive base surrounding the shell, conductive circuit board mounting posts on the base, a cavity of the base receiving at least one capacitor element in contact with the base, a conductive platform urging the capacitor element in contact with the base, the capacitor element being mounted against one side of the platform, the other side of the platform having a circuit board facing side, and conductive circuit board engaging terminals projecting from the other side of the platform.

10. An electrical connector as recited in claim 9, wherein, a conductive path from the capacitor element extends through the thickness of the platform to the circuit board engaging terminals.

11. An electrical connector as recited in claim 9, comprising: the platform is insulated from the base.

12. An electrical connector as recited in claim 9, wherein, insulative material in the cavity surrounds the capacitor element, and the platform is mounted to the insulative material.

* * * * *